US010212522B2

(12) United States Patent
Liu et al.

(10) Patent No.: US 10,212,522 B2
(45) Date of Patent: Feb. 19, 2019

(54) MULTI-CHANNEL DIGITAL MICROPHONE

(71) Applicant: YUTOU TECHNOLOGY (HANGZHOU) CO., LTD., Zhejiang (CN)

(72) Inventors: Xin Liu, Zhejiang (CN); Yujin Chen, Zhejiang (CN); Yongjun Zhou, Zhejiang (CN)

(73) Assignee: YUTOU TECHNOLOGY (HANGZHOU) CO., LTD., Hangzhou (CN)

( * ) Notice: Subject to any disclaimer, the term of this patent is extended or adjusted under 35 U.S.C. 154(b) by 208 days.

(21) Appl. No.: 14/764,297

(22) PCT Filed: Jun. 12, 2015

(86) PCT No.: PCT/CN2015/081411
§ 371 (c)(1),
(2) Date: Jul. 29, 2015

(87) PCT Pub. No.: WO2016/112635
PCT Pub. Date: Jul. 21, 2016

(65) Prior Publication Data

US 2016/0353211 A1 Dec. 1, 2016

(30) Foreign Application Priority Data

Jan. 12, 2015 (CN) ..... 2015 1 0014266

(51) Int. Cl.
*H04R 19/04* (2006.01)
*H04R 3/00* (2006.01)
*H04R 29/00* (2006.01)

(52) U.S. Cl.
CPC ..... *H04R 19/04* (2013.01); *H04R 3/005* (2013.01); *H04R 29/005* (2013.01);
(Continued)

(58) Field of Classification Search
CPC ..... H04R 19/04; H04R 3/005; H04R 29/005; H04R 2201/401; H04R 5/04; H04R 2410/01; H04R 2420/09
See application file for complete search history.

(56) References Cited

U.S. PATENT DOCUMENTS

2015/0127333 A1* 5/2015 Ubale ..... H04R 1/005 704/229
2015/0172811 A1* 6/2015 Sassi ..... H04R 3/002 381/71.1

(Continued)

FOREIGN PATENT DOCUMENTS

CN 201252640 6/2009
CN 201928428 8/2011
JP 2003062776 A * 3/2003

OTHER PUBLICATIONS

English machine translation (Koichi Otsu, Small-Sized Robot Communication System, Mar. 2003).*

*Primary Examiner* — Mark Fischer
(74) *Attorney, Agent, or Firm* — Fish IP Law, LLP

(57) ABSTRACT

The present invention relates to a multi-channel digital microphone, comprising: an array pickup unit and a processing unit, the array pickup unit comprises a plurality of pickup modules, arranged in array form, wherein each of the pick-up modules picks up the audio signals of the spatial region component, the array pickup unit converts a plurality of the audio signals of the spatial region component to a plurality of digital signal and outputs it; the pickup unit is connected to the processing unit, configured to extract and denoise the plurality of digital signals. The present invention adds a spatial region based on the time region and frequency region so that a pick-up de-noising process can be done for these received signals from different spatial directions.

11 Claims, 1 Drawing Sheet

(52) U.S. Cl.
CPC .... *H04R 2201/401* (2013.01); *H04R 2410/01* (2013.01); *H04R 2420/09* (2013.01)

(56) References Cited

U.S. PATENT DOCUMENTS

2016/0056781 A1* 2/2016 Rose ..... H03G 3/02 381/107
2016/0112807 A1* 4/2016 Yuan ..... H04R 19/04 381/174

* cited by examiner

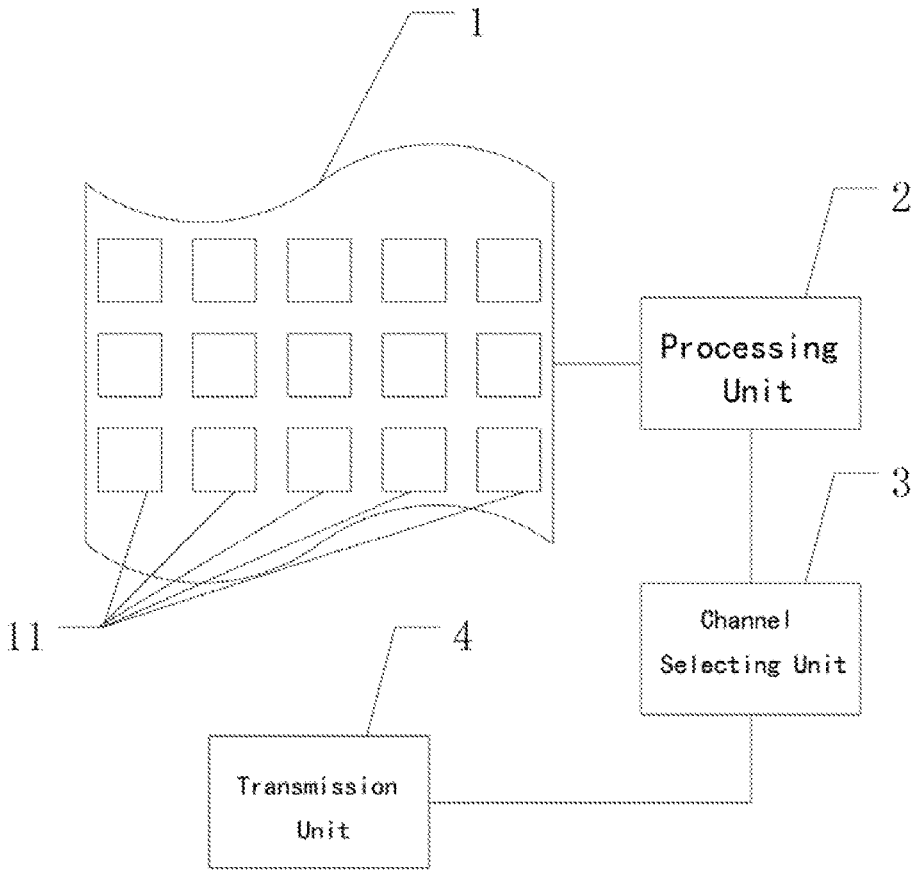
1
2
Processing Unit
3
Channel Selecting Unit
11
4
Transmission Unit

MULTI-CHANNEL DIGITAL MICROPHONE

This application is a U.S. National Phase of PCT/CN2015/081411, filed Jun. 12, 2015, which claims priority to Chinese Patent Application No. 201510014266.6, filed Jan. 12, 2015.

FIELD OF THE INVENTION

The present invention relates to a pickup device, and more particularly relates to a multi-channel digital microphone USB interface.

DESCRIPTION OF THE RELATED ART

As a voice picker, microphones are widely used in a variety of voice communications scenes, such as a stage, large conference room, the news site, remote video conferencing, voice chatting and voice recognition.

Currently when using the microphone isolated microphone is usually mainly used. In a real environment, the single microphone pickup range is limited, all sound pickup range (including noise) will be accepted. Accordingly, a single audio signal received by the microphone, is usually caused by a plurality of sound sources and noise superposition surroundings thereof. Since the sound source (speaker) may move in the range of the process output in a certain area, but there may be other sources of multipath reflections and reverb and other factors within the pickup range, these factors will cause to decrease the SNR the audio signal received by a single microphone, resulting in reducing the audio quality. On the noise processing, conventional microphones commonly used frequency region to offset power spectrum and suppress noise by using filtering techniques. However, the received audio signal typically overlap each other in time and frequency spectrum, therefore, it is very difficult to separate the different audio and effectively suppress noise and interference, it is poor for de-noising.

SUMMARY OF THE INVENTION

Directing at the above-mentioned problems of the prior existence of a single microphone, the present invention now provides a multi-channel digital microphone, which adds a spatial region on the basis of the time region and frequency region so that a pickup de-noising process can be done for these received signals from different spatial directions.

The technical solution of the invention is:

A multi-channel digital microphone, including:

An array pickup unit, comprising a plurality of pickup modules, arranged in array form, wherein each of the pickup modules picks up audio signals of the spatial region component, the array pickup unit converts a plurality of the audio signals of the spatial region component to a plurality of digital signal and outputs it;

A processing unit, connected to the array pickup unit, configured to extract and denoise the plurality of digital signals.

Preferably, further comprising:

A clock signal, comprising a high level and a low level;

A channel selecting unit, connected to the processing unit, configured to, based on the high level and the low level, divide the plurality of digital signals which are processed by the processing unit into two channels.

Preferably, further comprising:

A transmission unit, connected to the channel selecting unit, configured to output the digital signal.

Preferably, wherein the pickup module uses silicon thin films to pick up the audio signal of the spatial region component.

Preferably, wherein the digital signal output by the array pickup unit is a pulse density modulated signal.

Preferably, wherein the processing unit comprises a decimation filter which is configured to perform a low-pass filtering to the digital signals, and then to converts the digital signals into digital signals with low frequency and high flow, and to perform a digital filtering.

Wherein, the transmission unit employs a USB interface module.

A sound source localization system, characterized by comprising: the multi-channel digital microphone as described in above.

The benefit of the invention compared to the prior art is:

The present invention adds a spatial region based on the time region and frequency region so that a pick-up de-noising process can be done for these received signals from different spatial directions. Using a plurality of pick-up module may constitute a spatial region in the array by an array of pick-up unit in the spatial region multiple directions pick up audio signals; the processing unit can do de-noising process for audio signals to improve audio quality.

BRIEF DESCRIPTIONS OF THE DRAWINGS

FIG. 1 is a module diagram of the multi-channel digital microphone of an embodiment according to the invention.

DETAILED DESCRIPTIONS

The present invention will be combined with the implementation of the drawings, it was a clear example and a complete description of the technical solutions of the present invention, obviously, the described embodiments are only part of the embodiments of the present invention, but not all embodiments. Based on the embodiments of the present invention, those of ordinary skill obtain all other embodiments in the premise of he does not make creative work, are within the scope of the present invention to protect.

It should be noted that, without conflict, in the embodiment of the present invention and features of embodiments can be combined with each other.

The following is the further description of the invention by combining the drawing and the embodiments, and it can not be the limitation for the invention.

As shown in FIG. 1, a multi-channel digital microphone, comprising:

An array of pick-up unit 1 and a processing unit 2, the array pickup unit 1 comprises a plurality of pickup modules 11, wherein the plurality of pick-up modules 11 arranged in an array form, wherein each of pickup modules 11 picks up the audio signal of the spatial region component, the array pickup unit 1 converts a plurality of the audio signal of the spatial region component to a plurality of digital signal output; the array pickup unit 1 is connected to the processing unit 2 so that plurality of digital signals can be extracted and the de-noising process can be done.

In the present embodiment, using a plurality of pickup modules may constitute a spatial region in the array by an array pickup unit 1 in the spatial region multiple directions pick up audio signals; an array pickup unit 1 can convert a plurality of audio signal of the spatial region component into a plurality of digital signal output, the spatial region component is decided by spatial location of the pickup module in the array. The processing unit 2 can do de-noising process for audio signals to improve audio quality.

Furthermore, the processing unit 2 may be a digital signal processing chip (Digital Signal Process, DSP), DSP chip has these advantages such as embeddability, high-speed performance, good stability and high precision, DSP chip can convert the signal of high-frequency flow into low-high flow signal.

In a preferred embodiment, it may further comprise:

A clock signal and channel selecting unit 3, the clock signal comprises a high level and a low level; the channel selecting unit 3 is connected to the processing unit 2, a plurality of digital signals based on the high and low level of the clock signal through the processing unit 2 processes will be divided into two channels.

In the present embodiment, the channel selecting unit 3 divides the received digital signal into a plurality of channels, in order to improve the audio of layering and three-dimensional effect.

In a preferred embodiment, further comprising:

A transmission unit 4, connected to the channel selecting unit, configured to output the digital signal.

In the present embodiment, digital signal can be sent to the mobile terminal by the transmission unit 4.

In a preferred embodiment, the pickup module 11 uses the silicon thin film to pick up an audio sound pressure signal of a spatial component. Silicon thin film can be used to detect the sound pressure.

In a preferred embodiment, the digital signal of the array pickup unit output is for the pulse density modulation (Pulse Density Modulation, PDM), the more intense the amplitude of PDM signal changes, the more dense pulse density is.

In the present embodiment, the multi-channel digital microphone is equivalent to a microphone array constituted by a plurality of pickups. It adds a spatial region on the basis of the time region and frequency region to deal with these received signals from different spatial directions.

It can be converted by the audio signal picked up into a PDM signal, and outputs it to DSP chips for processing, using of digital technology can effectively solve the problem of sound isolation and noise suppression, thereby enhance the ability to pick up audio signals.

In a preferred embodiment, the processing unit 2 may include a decimator, the decimator is used for low-pass filtering the digital signal, then converts the digital signal into a digital signal with low frequency and high flow, and then does digitization filtering.

In this embodiment, does sampling under the decimator and make low-pass filtering, and then the high-frequency signal can be converted into a PCM signal with high flow and low frequency, while filtering out the quantization noise, and then achieve the digital signal digital filtering and gain regulation.

In a preferred embodiment, the transmission unit 4 may be the USB interface module.

In this embodiment, USB interface module support hot-swapping, and unified standard, it can be connected with mobile terminals, then digital signals can be transmitted to the mobile terminal by high speed.

A sound source localization system, includes multi-channel digital microphone.

In this embodiment, the sound source localization system can be used in smart home robot, the sound source localization system can locate the source of a digital multi-channel audio signals received by the microphone, search and move following the sound source. Extraction and separation of audio signal and de-noising through multiple channels of digital microphone can improve real-time requirement and accuracy of sound source localization system.

In this embodiment, the multi-channel digital microphone can also be applied in the source eliminating system of the smart home robot, when the robot plays music, it will affect the audio recognition function, now audio signal of the spatial region component can be converted into a plurality of digital signals through multi-channel digital microphone, and then send audio signals Android devices through USB interface module to eliminate the source itself, in order to achieve the robot's own sources cancellation.

The above described preferred embodiments of the present invention do not limit the possible variations of the invention, and those skilled in the art can make various modifications and changes that do not exceed the scope of the invention. Any modification made within the spirit and principle of the present invention by replacement with equivalent or improved features falls within the scope of the present invention.

What is claimed is:

1. A multi-channel digital microphone used in a smart home robot, comprising:

an array pickup unit, comprising at least three pickup modules arranged in array form on a surface, wherein each of the at least three pickup modules picks up audio signals of the spatial region component, wherein the spatial region component is decided by a spatial location of the pickup module in the array, wherein the array pickup unit converts a plurality of the audio signals of the spatial region component to a plurality of digital signals and outputs it, wherein each of the at least three pickup modules picks up different audio signals from different spatial directions, and wherein the plurality of the audio signals of the spatial region component comprises the different audio signals;

a processing unit connected to the array pickup unit, configured to extract and denoise the plurality of digital signals; and a transmission unit, connected to the channel selecting unit, configured to output the plurality of digital signals, wherein the plurality of digital signals can be sent to a mobile terminal by the transmission unit, and wherein the transmission unit employs a Universal Serial Bus interface module.

2. The multi-channel digital microphone as described in claim 1, further comprising:

a clock signal comprising a high level and a low level;

a channel selecting unit, connected to the processing unit, configured to, based on the high level and the low level, divide the plurality of digital signals which are processed by the processing unit into two channels.

3. The multi-channel digital microphone as described in claim 1, wherein the at least three pickup modules use silicon thin films to pick up the audio signal of the spatial region component.

4. The multi-channel digital microphone as described in claim 1, wherein the plurality of digital signals output by the array pickup unit are pulse density modulated signals.

5. The multi-channel digital microphone as described in claim 1, wherein the processing unit comprises a decimation filter which is configured to perform a low-pass filtering to the digital signals, and then to convert the digital signals into digital signals with low frequency and high flow, and to perform a digital filtering.

6. The multi-channel digital microphone of claim 1, wherein each of the pickup modules picks up different audio signals from different spatial directions, and wherein the plurality of the audio signals of the spatial region component comprises the different audio signals.

7. A sound source localization system used in a smart home robot, comprising a multi-channel digital microphone;

the multi-channel digital microphone comprising:

an array pickup unit, comprising at least three pickup modules arranged in array form on a surface, wherein each of the at least three pickup modules picks up audio signals of the spatial region component, wherein the spatial region component is decided by a spatial location of the pickup module in the array, wherein the array pickup unit converts a plurality of the audio signals of the spatial region component to a plurality of digital signals and outputs it, wherein each of the at least three pickup modules picks up different audio signals from different spatial directions, and wherein the plurality of the audio signals of the spatial region component comprises the different audio signals;

a processing unit is connected to the array pickup unit, configured to extract and denoise the plurality of digital signals; and a transmission unit, connected to the channel selecting unit, configured to output the plurality of digital signals, wherein the plurality of digital signals can be sent to a mobile terminal by the transmission unit, and wherein the transmission unit employs a Universal Serial Bus interface module.

8. The sound source localization system as described in claim 7, further comprising:

a clock signal comprising a high level and a low level;

a channel selecting unit, connected to the processing unit, configured to, based on the high level and the low level, divide the plurality of digital signals which are processed by the processing unit into two channels.

9. The sound source localization system as described in claim 7, wherein the at least three pickup modules use silicon thin films to pick up the audio signal of the spatial region component.

10. The sound source localization system as described in claim 7, wherein the plurality of digital signals output by the array pickup unit are pulse density modulated signals.

11. The sound source localization system as described in claim 7, wherein the processing unit comprises a decimation filter which is configured to perform a low-pass filtering to the digital signals, and then to convert the digital signals into digital signals with low frequency and high flow, and to perform a digital filtering.

* * * * *